US005848486A

United States Patent [19]

Mitchell et al.

[11] Patent Number: 5,848,486

[45] Date of Patent: Dec. 15, 1998

[54] LINE OF SIGHT TEMPERATURE CONTROL AND METHOD FOR LAUNDRY IRONERS

[75] Inventors: James E. Mitchell, Algonquin; Bruce W. Johnson, Golf, both of Ill.

[73] Assignee: FinishTech, Ltd., Morton Grove, Ill.

[21] Appl. No.: 865,318

[22] Filed: May 29, 1997

[51] Int. Cl.[6] ..... D06F 65/02; G01S 05/48

[52] U.S. Cl. ..... 38/44; 374/121

[58] Field of Search ..... 38/1 R, 44, 63; 374/120, 121, 126, 153, 132

[56] References Cited

U.S. PATENT DOCUMENTS

| | | | |
|---|---|---|---|
| 3,653,263 | 4/1972 | Poole et al. . | |
| 4,562,655 | 1/1986 | Bosshart et al. . | |
| 4,677,773 | 7/1987 | Kamberg . | |
| 4,765,752 | 8/1988 | Beynon et al. . | |
| 5,242,224 | 9/1993 | Yoshioka et al. . | |
| 5,262,101 | 11/1993 | Yagi et al. . | |
| 5,275,489 | 1/1994 | Borneman et al. . | |
| 5,289,766 | 3/1994 | Conrad et al. . | |
| 5,551,175 | 9/1996 | Neyman | 38/44 |
| 5,660,470 | 8/1997 | Mench | 374/121 |

OTHER PUBLICATIONS

The IRt/c™ Book, Third Edition, ©Exergen Corp., "Handbook of Non–Contact Temperature Sensors", 1996, pp. 8, 9, 12, 13, 22, 50, 51, 53, 65, 72, 75, 128.

IRt/c™, ©Exergen Corp., "Cost Sheet".

Infrared Thermocouple: IR t/c™ Operating Principles—Temperature with Striking Speed and Accuracy—Exergen Corp., 1992, pp. 1–39.

*Primary Examiner*—Ismael Izaguirre

*Attorney, Agent, or Firm*—Brinks Hofer Gilson & Lione; Craig A. Summerfield

[57] ABSTRACT

An apparatus and a method controls a heating device in a laundry ironer. The apparatus includes a frame and an ironer cylinder. The ironer cylinder rotatably connects to the frame and has an interior surface and an exterior surface. The interior and exterior surfaces extend substantially from a first end to a second end of the ironer cylinder. A line of sight temperature sensor connects to the frame near the first end wherein a line of sight of the sensor is directed at a portion of the interior surface of the cylinder. As the ironer cylinder rotates and is heated by a heating element, the temperature of a portion of the interior surface is sensed. Based on the temperature and a threshold, the state of the heating element is changed.

21 Claims, 2 Drawing Sheets

LINE OF SIGHT TEMPERATURE CONTROL AND METHOD FOR LAUNDRY IRONERS

FIELD OF THE INVENTION

This invention relates in general to laundry ironers and in particular to temperature sensing and control of heating devices in laundry ironers.

BACKGROUND OF THE INVENTION

Laundry ironers, such as gas burner laundry ironers, generally comprise a system of belts for conveying a wet or damp sheet or other textile around a rotating cylinder. In particular, the textile is passed over a portion of an exterior surface of the cylinder, such as around ¾ of the circumference. The exterior surface is polished and smooth. A gas burner provides heat to the inside of the cylinder. The heat conducts from the inside of the cylinder to the exterior surface. The heat and rotation dry and iron the textiles.

The amount of heat applied to the textiles is regulated. Typically, a surface contact temperature sensor detects the temperature of a narrow portion of the exterior surface of the rotating cylinder. For example, the surface contact sensor is a one inch copper block with a thermocouple sensor inserted into the block. The contact sensor is placed in contact with the rotating cylinder at a position where no textiles are passed. A spring mount maintains contact between the contact sensor and the exterior surface of the cylinder.

The contact sensor is used to control the amount of heat provided to the textiles. The heat provided from the exterior surface is conducted to the contact sensor. The temperature is determined using the thermocouple. If the temperature is above a certain value, such as 400° Fahrenheit, then the gas burner is turned off. If the temperature is below a certain value, such as 388° Fahrenheit, then the gas burner is turned on.

A second contact sensor is used as a safety back up. For example, if the temperature detected by the second contact sensor is above 440° Fahrenheit, then the gas burner is turned off. Thus, if the first contact sensor fails, then the second contact sensor prevents over heating.

A number of problems that may occur are associated with temperature control using contact sensors. If the textiles being ironed have less width than the length of the cylinder, then the temperature sensed may be different from that applied to the textiles.

Another problem with contact sensors is the mass of the sensors. Due to the mass of the copper block, the contact sensor is slow to respond to changes in temperature. Thus, a lag or an inaccuracy is introduced in the control of the temperature.

Yet another problem with the contact sensors is sensor damage. Both general wear and pulling out of jammed textiles can result in contact sensor damage. The damage typically requires replacement of the contact sensor.

Finally, temperature control with the contact sensor is inefficient due to lint and wax buildup. Wax is applied as a surface lubricant to the cylinder so that textiles pass smoothly over the polished exterior surface. Additionally, lint from the textiles collects on the cylinder and on the temperature sensor. The lint and wax thermally insulate the contact sensor from the cylinder. Thus, a consistent temperature is not detected.

The contact sensor is not entirely satisfactory for these reasons and others. It is therefore desirable to provide improved temperature control of the heating device in the gas burning laundry ironer.

SUMMARY OF THE INVENTION

The invention provides an efficient method and system for controlling a heating device in a laundry ironer. In one aspect, an apparatus and a method for ironing textiles and controlling the temperature applied to the textiles includes a frame and an ironer cylinder. The ironer cylinder rotatably connects to the frame and has an interior surface and an exterior surface. The interior and exterior surfaces extend substantially from a first end to a second end of the ironer cylinder. A line of sight temperature sensor connects to the ironer frame near the first end of the ironer cylinder, and the line of sight temperature sensor is directed at a portion of the interior surface. As the ironer cylinder rotates and is heated by a heating element, the temperature of a portion of the interior surface is sensed. Based on the temperature and threshold values, the state of the heating element is changed.

In another aspect of the invention, the apparatus includes a frame and a rotatable cylinder connected to the frame. The rotatable cylinder has an interior surface and an exterior surface and a center axis. A temperature sensor with a line of sight connects to the frame with the line of sight directed at a portion of the interior surface at an acute angle to the center axis of the ironer cylinder.

The foregoing and other features and advantages of the invention will become further apparent from the following detailed description of the presently preferred embodiments, read in conjunction with the accompanying drawings. The detailed description and drawings are merely illustrative of the invention rather than limiting. The scope of the invention is defined by the appended claims and equivalents thereof.

DETAILED DESCRIPTION OF PREFERRED EMBODIMENTS

Figure 1:
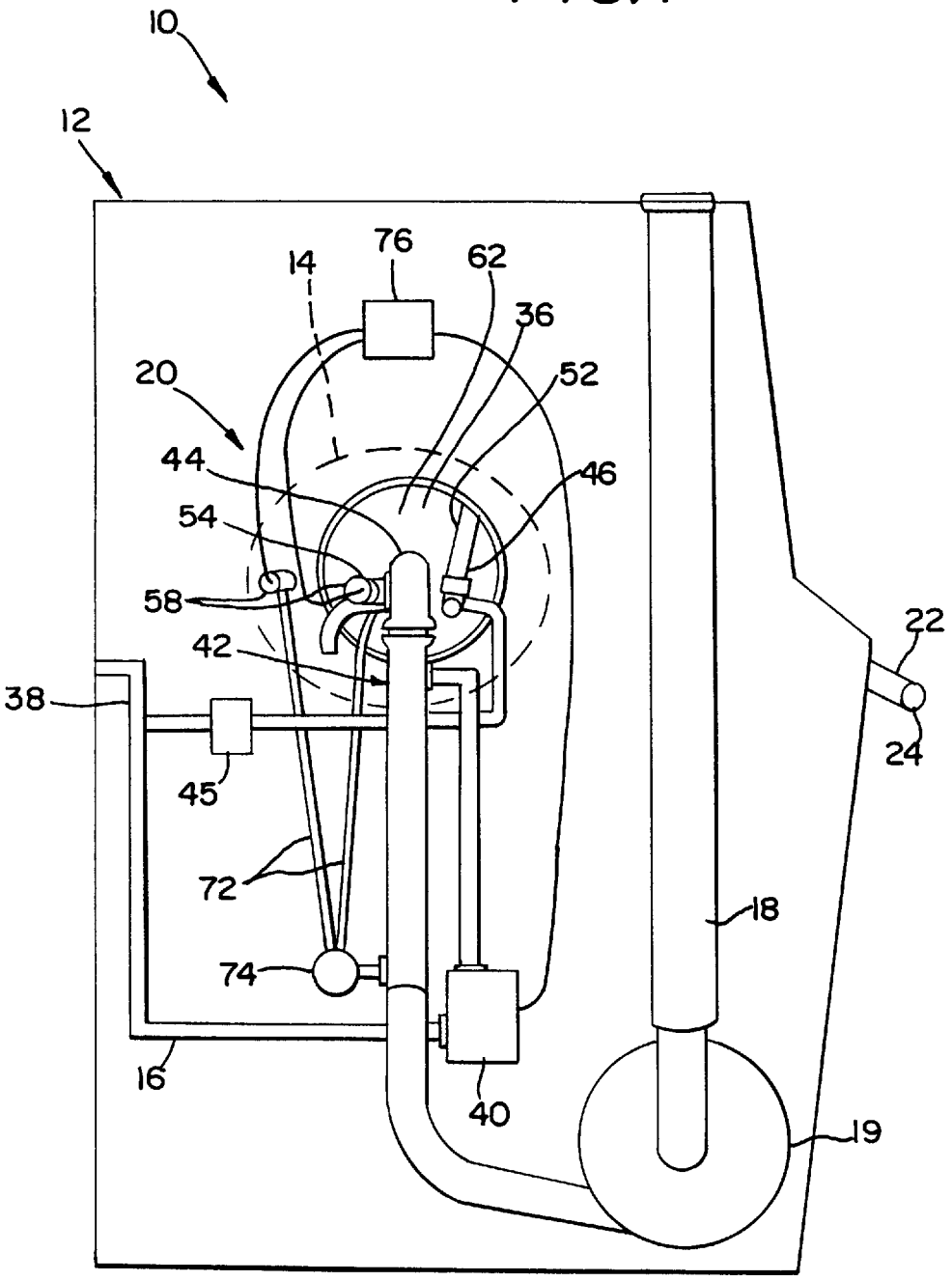
FIG. 1 is a side view of a laundry ironer with line of sight temperature control.

Referring now to the figures, FIG. 1 is a side view of laundry ironer with a line of sight temperature control. The laundry ironer 10 largely is conventional in the art and well known in its structure and operation. The laundry ironer 10 comprises a frame structure 12, a cylinder 14, a heating system 16, and an air system 18. A new temperature control system is generally shown at 20.

The frame structure 12 supports various components of the laundry ironer 10. Preferably, the frame structure 12 is made from various steel components, such as plates and bars as is known in the art. The frame structure 12 supports a series of textile transport belts 22 and rollers 24. The belts 22 and rollers 24 transfer textiles through the laundry ironer 10. As known in the art, the belts 22 are driven by various motors.

The frame structure 12 also supports the cylinder 14. The frame structure 12 may support more than one cylinder 14. For simplicity, a laundry ironer 10 with one cylinder 14 is discussed below. The temperature control for each cylinder 14 in a multi-cylinder 14 ironer is generally the same.

Figure 2:
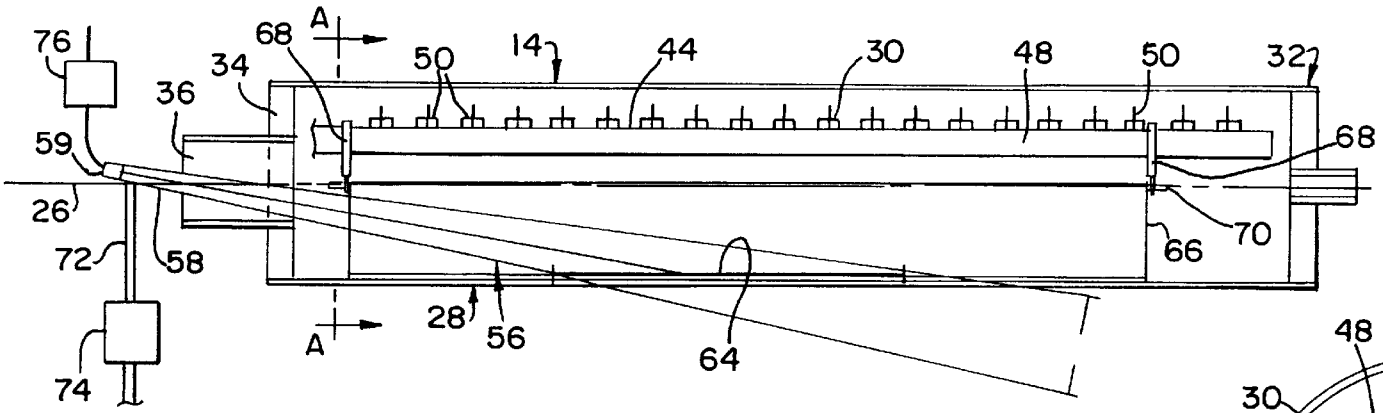
FIG. 2 is a front view of a cylinder and other components in the laundry ironer of FIG. 1.
Figure 4:
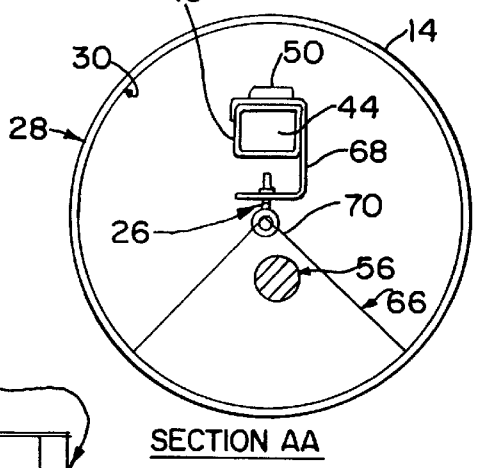
FIG. 4 is a cross sectional view of FIG. 2 along line A—A.
Figure 3:
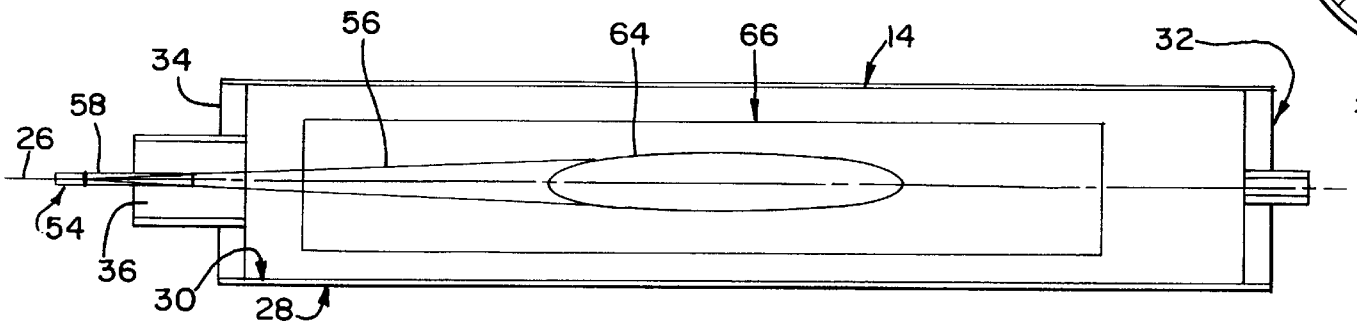
FIG. 3 is a top view of the cylinder, a shield and a line of sight temperature sensor of FIG. 2.

The cylinder 14 is made from steel, but may comprise other materials. Referring now to FIGS. 2 through 4, the cylinder 14 is generally hollow and extends along a center axis 26. Thus, the cylinder 14 has an exterior surface 28 and an interior surface 30. Preferably, a first end 32 of the cylinder 14 is substantially open or comprises steel spokes. The second end 34 of the cylinder 14 narrows, but an opening 36 is provided, as known in the art. Preferably, the second end 34 also comprises steel spokes. The exterior surface 28 is polished, and has a smooth, shiny appearance. Preferably, the interior surface 30 is not machined and typically has a rust or other dull surface. Alternatively, a dull or non-reflective surface may be added as a separate component on least a portion of the interior surface 30.

Referring back to FIG. 1, the cylinder 14 is mounted within the frame structure 12 as known in the art. In particular, the first and second ends 32 and 34 of the cylinder 14 are rotatably mounted on the frame structure 12, such as mounting using support rollers with bearings. As known in the art, a drive motor and associated drive chain (not shown) or other means provide force to the cylinder 14 for rotation.

The frame structure 12 also supports the heating system 16. Referring now to FIGS. 1, 2 and 4, the heating system 16 comprises a gas supply 38, a valve system 40, a mixer 42, heating elements 44, and a pilot system 46. The heating system 16 is an air-gas mixture device known in the art, but a bunson burner air over device may be used. The heating system 16 may comprise other heating systems, such as novel heating systems.

The gas supply 38 is typically a series of steel pipes for supplying pressurized gas to the valve system 40 and pilot valve 45. Gas from the pilot valve 45 is provided to the pilot system 46, as known in the art. The valve system 40 preferably comprises two gas valves, one operational valve and one safety valve. Preferably, the valves are gas safety approved valves. The valve system 40 also has an electrical input. Based on the electrical input, the amount of pressurized gas allowed through the valve system 40 is changed, such as by partly or fully opening or closing the valves. Gas supplied through the valve system 40 is provided to mixer 42.

The air system 18 supplies air to the mixer 42. Using a flexible or rigid tube, air is sucked into the laundry ironer 10 by a fan 19, as known in the art. Preferably, the fan 19 is a centrifugal blower with flat radial blades. The fan 19 forces the air into the mixer 42.

At the mixer 42, the gas from the valve system 40 and air from the air system 18 are mixed. Preferably, the mixer 42 is a low pressure venturi mixer. The air-gas mixture proceeds to the heating element 44.

The heating element 44 includes a chamber 48 and multiple burners 50. As known in the art, the chamber is a steel tube. The burners 50 are constructed as known in the art, such as circular brass devices inserted into holes on the chamber 48. As shown in FIG. 2, the chamber 48 extends from the opening 36 to near the first end 32 of the cylinder 14. The burners 50 are spaced along the entire chamber 48, preferably on the top side of chamber 48.

The pilot system 46 includes an in-feed from the pilot valve 45, an electrical spark device (not shown) and a tube 52 extending from the gas supply 38 to one of the burners 50. Other pilot systems 48 or ignition devices may be used.

Using the various components of the heating system 16, heat is applied to the cylinder 14. As known in the art, the pilot system 46 provides a starting flame using gas provided by gas supply 38, and ignited with the electrical spark device. Gas supply 38 also supplies gas through the valve system 40 to the mixer 42. The air system 18 provides air to the mixer 42. The mixer 42 supplies the air-gas mix through the chamber 48 to the burners 50. The pilot flame near one of the burners 50 ignites the air-gas mixture at that burner 50. The flame then ignites air-gas mixture provided out of the other burners 50. The flames from the burner 50 provide heat to the rotating cylinder 14 during operation of the laundry ironer 10.

Referring to FIG. 1, to control the amount of heat provided by the heating element 44, the temperature control system 20 monitors the temperature of the cylinder 14. The temperature control system 20 includes two temperature sensors 54 for redundancy and safety. More or fewer temperature sensors 54 may be used. Each temperature sensor 54 is an infra-red device with a line of sight 56 for measuring remote temperatures. Preferably, each temperature sensor 54 is a model IRt/c.10-k-340F/170C manufactured by Exergen of Watertown, Mass. Other infra-red temperature sensors could be used. Preferably, the infra-red temperature sensors output a signal of sufficient strength for operation of the processor 76. The temperature sensors 54 preferably have the highest accuracy for reading 250°–400° F. temperatures and withstand exposure to an ambient temperature of 212° F. Preferably, the line of sight 56 is a cone with a six inch diameter at sixty inches from the face of each temperature sensor 54.

Referring to FIGS. 1–3, the two above described temperature sensors 54 are mounted in sensor tubes 58. Each sensor tube 58 is a steel tube with an inner diameter corresponding to the outer-diameter of each temperature sensor 54. Other materials and structures for the sensor tube 58, or no sensor tube 58, may be used. Each sensor tube 58 extends from its temperature sensor 54 generally parallel to the line of sight 56 of the temperature sensor 54. Preferably, the sensor tube 58 does not impede the conical line of sight 56 of its temperature sensor 54.

Referring to FIG. 1, the sensor tubes 58 with the associated temperature sensors 54 are mounted to the frame structure 12. Each sensor tube 58 may be mounted in any of various ways. For example, the sensor tube 58 with the associated temperature sensor 54 to be used as the safety backup temperature sensor is mounted within a hole in the frame structure 12. The diameter of the hole is preferably drilled or formed to match the outer diameter of the sensor tube 58. The sensor tube 58 is then slid into the hole and welded onto the frame structure 12. Preferably, the hole on the frame structure 12 is oriented so that the sensor tube 58 and the line of sight 56 extend through the opening 36 of the cylinder 14 at an angle as discussed below. As another example and preferably, both sensor tubes 58 are mounted adjacent the mixer 42. Either a bracket around the mixer 42, or an extension from or to the frame structure 12, or both is provided to mount each sensor tube 58 to the frame structure 12. The bracket uses a U-shaped bolt with two nuts to connect to a plate mounted to the sensor tube 58. Preferably, welding and a bracket mounts each sensor tube 58 to the frame structure 12. The sensor tube 58 extends through a frame structure opening 62 and into the opening 36 on the second end 34 of the cylinder 14. Thus, the temperature sensors 54 do not contact the cylinder 14. Instead, each temperature sensor 54 measures the temperature of a surface contacted or read by the line of sight 56 as shown in FIGS. 2 and 3. By directing both temperature sensors 54 through opening 36, the spokes on the second end 34 do not interfere with temperature sensing.

A cooling line 72 connects to each sensor tube 58 adjacent to the temperature sensor 54. The cooling line 72 is semi-rigid metal tubing, such as aluminum, but other materials and structures, such as pipes or conduit, may be used. The air system 18 provides air to the cooling line 72. In particular, air is provided from the fan 19 to a filter 74, such as a paper or synthetic filter. Filtered air is provided from the filter 74 to the cooling line 72. The air enters the sensor tube 58 adjacent the temperature sensor 54 and exists the opposite end of the sensor tube 58. The filtered air, in combination with positioning the temperature sensor 54 outside of the cylinder 14, helps keep the temperature near the temperature sensor 54 below 212° F. versus the 400° F. or more typically found inside the cylinder 14. The filtered air also acts to purge wax vapor, water vapor, lint, products of combustion, and other airborne contaminants from the sensor tube. Other cooling systems such as liquid based cooling systems may be used.

Referring now to FIGS. 2 through 4, the line of sight 56 of one temperature sensor 54 is shown. The sensor tube 58 is mounted so that the line of sight 56 is directed towards a portion 64 of the interior surface 30. Preferably, both temperature sensors 54 are directed to the same location, but may be directed to different locations. The sensor tube 58 and the line of sight 56 are at an acute angle downward from the center line 26. The angle is preferably 8° to 16° depending on the diameter and depth of the opening 36 on the cylinder 14. Based on the conical shape of the line of sight 56 and the angle, the portion 64 of the interior surface 30 covers a substantial length of the interior surface 30 parallel to the center line 26.

The line of sight 56 of the temperature sensor 54 is protected from infra red radiation from the flames of the burner 14 by various shielding. In particular, the sensor tube 58 limits the amount of infra red radiation detected by the temperature sensor 54. Additionally, a shield 66 limits the infra red radiation sensed by the temperature sensor 54. The shield 66 preferably comprises a sheet of steel bent along a center line at approximately a 90% angle, but other materials and configurations may be used. The shield 66 is mounted within the cylinder 14, but does not contact the interior surface 30. Preferably, but not necessarily, the shield 66 is mounted to the heating element 44. Referring to FIGS. 2 and 4, one or more brackets 68 hang from the chamber 48. The brackets 68 may be welded or otherwise connected to the chamber 48. A rod 70 connects to each of the brackets 68. The shield 66 hangs from the rod 70. Preferably, the shield 66 is welded to the rod 70. Other structures for mounting the shield 66 may be used, such as bolting or hanging. Preferably, the shield 66 extends from adjacent one end 34 to another end 32 of the cylinder 14. Preferably, all direct paths between any burner and the portion 64 of the interior surface 30 is blocked by shield 66. However, other amounts of coverage by the shield 66 may be used. The shield 66 limits the amount of infra red radiation passing from the burners 50 onto the portion 64 of the interior surface 30.

Each temperature sensor 54 outputs an electrical signal corresponding to the detected temperature of the portion 64 of the interior surface 30. The electrical signal is provided to a processor 76. The processor 76 is preferably a digital temperature control, such as manufactured by Fuji. Preferably, the processor 76 samples the electrical signals output from temperature sensor 54 at periodic rate, such as several samples per second. The samples from the last 12 to 24 seconds are averaged. The average represents the temperature over one or more revolutions of the cylinder 14. Preferably, the averaging discussed herein is based on the size of the cylinder 14, but the averaging may be changed, such as averaging more samples or providing weights to each sample. The average preferably reflects the temperature around the circumference of the interior surface 30 measured over two rotations, so that hot or cold spots do not render the temperature control erratic. The more temperature variations, such as due to the varying thickness in larger cylinders, the more samples and corresponding rotations are preferably included in the average. The average is compared to various thresholds to control the valve system 40. Thus, the processor 76 generates a control signal responsive to the electric signal to control the valve system 40. If the average temperature is above a threshold value, such as a value corresponding to a temperature of 400° F., the processor 76 generates a control signal to close the valves within valve system 40. Thus, the gas is not provided to mixer 42 and the flames at burners 50 will extinguish from lack of fuel. Alternatively, the amount of gas provided is decreased. If the average temperature is below another threshold value, corresponding to a low temperature such as 388° F., then the processor 76 generates a control signal to open the valves within valve system 40. Thus, gas is provided to the mixer 42 and burners 50. The pilot flame then ignites the air-gas mixture from the burners 50. Alternatively, the amount of gas provided is increased.

The temperature sensor 54 used as the safety temperature sensor also provides an electrical signal to the processor 76 or a separate processor. For example, an analog high limit control manufactured by Zytron is used. For purposes of the discussion below, the analog control is treated as part of the processor 76. The processor 76 samples the electrical signal in accordance with the sampling theorem discussed above to calculate an average temperature. This average temperature is compared to yet another threshold, corresponding to a high temperature such as 420° F. If the second average temperature is greater than the high temperature threshold, the processor 76 generates a control signal to close the valves in valve system 40. Other sampling theorems may be used. Additionally, other methods of calculating the temperature, such as not averaging the samples, may be used.

Due to the dull or rust-coated interior surface 30, the temperature sensor 54 detects the temperature of the portion 64 of the interior surface 30 even at the slight angle of the line of sight 56 to the interior surface 30. Thus, the temperature is detected over a large portion 64 of the interior surface 30 as the cylinder 14 rotates. Typically, the interior surface 30 is five degrees warmer than the exterior surface 28 of the cylinder 14 during heating. Based on this known conduction and the desired temperature to be provided to the textiles, the thresholds within processor 76 are set.

While the invention has been described above by reference to the various embodiments, it will be understood that many changes and modifications can be made without departing from the scope of the invention. For example, the line of sight 56 may be directed at a larger or smaller portion 64 of the interior surface 30. The shield 66 may be removed and infrared radiation accounted for based on measured amounts of radiation. Other laundry ironers, such as using a Bunson type burner or chest ironers, may be used.

It is therefore intended that the foregoing detailed description be understood as an illustration of the presently preferred embodiment of the invention and not as a definition of the invention. It is only the following claims, including all equivalents, that are intended to define the scope of this invention.

We claim as our invention:

1. An apparatus for ironing textiles and controlling the temperature applied to the textiles, comprising:

a frame;

an ironer cylinder rotatably connected to said frame and comprising an interior surface and an exterior surface, both the interior and exterior surfaces extending substantially from a first end to a second end of said ironer cylinder; and a line of sight temperature sensor operatively connected to said frame near said first end and directed to read a portion of said interior surface.

2. The apparatus of claim 1 wherein:

said ironer cylinder comprises a gas burner ironer cylinder;

said exterior surface comprises a polished surface;

said interior surface comprises a dull surface; and a heating element extends within said ironer cylinder.

3. The apparatus of claim 1 wherein:

said first end comprises an first opening;

said frame comprises a second opening adjacent said first opening; and said line of sight temperature sensor operatively connects to said frame adjacent said second opening.

4. The apparatus of claim 1 wherein said line of sight temperature sensor comprises an infra-red temperature sensor.

5. The apparatus of claim 1 further comprising a processor for calculating an average of signals provided from said line of sight temperature sensor.

6. The apparatus of claim 1 further comprising a shield extending through the space between a heating device and said portion of said interior surface.

7. The apparatus of claim 6 wherein:

said heating device comprises a series of gas burner elements on a tube within said cylinder; and said shield comprises a sheet extending from adjacent a first end to adjacent a second end of said tube and operatively connected to said tube.

8. The apparatus of claim 1 further comprising:

a sensor tube connected to said line of sight temperature sensor and extending within said ironer cylinder; and a cooling line operatively connected to said sensor tube adjacent said line of sight temperature sensor.

9. The apparatus of claim 1 wherein said line of sight temperature sensor operatively connects to said frame with said line of sight directed at an acute angle to a center axis of said cylinder.

10. The apparatus of claim 1 further comprising a second line of sight temperature sensor operatively connected to said frame adjacent said first end wherein a line of sight of said second line of sight temperature sensor is operatively directed at said interior surface.

11. A method for ironing textiles and controlling a heating device comprising:

rotating an ironer cylinder operatively connected to a frame, the ironer cylinder comprising an interior surface and an exterior surface, both the interior and exterior surface extending substantially from a first end to a second end of said ironer cylinder;

heating the ironer cylinder with said heating device;

sensing a temperature of a portion of said interior surface of said ironer cylinder with a non-contact, line of sight temperature sensor; and changing the state of the heating element in response to said temperature and a first threshold value.

12. The method of claim 11 further comprising the step of calculating an average temperature based on multiple of said first temperatures; wherein the step of changing the state of the heating element is responsive to said average temperature.

13. The method of claim 12 wherein the step of calculating comprises calculating said average as a function of time.

14. The method of claim 11 further comprising shielding said line of sight temperature sensor from reading radiation directly from said heating element.

15. The method of claim 14 wherein said shielding step comprises an opaque shield between said heating element and said portion of said interior surface.

16. The method of claim 14 wherein said shielding step comprises providing a sensor tube extending from said line of sight temperature sensor to at least adjacent said sheet.

17. The method of claim 11 further comprising the step of cooling said line of sight temperature sensor.

18. The method of claim 11 further comprising the steps of:

sensing a second temperature of a second portion of said interior surface of said ironer cylinder with a second line of sight temperature sensor; and changing the state of said heating element in response to said second temperature and a second threshold value higher than said first threshold value.

19. The method of claim 11 wherein said changing step comprises turning said heating element off if said first temperature is above a threshold value.

20. An apparatus for controlling a heating device comprising:

a frame;

a cylinder rotatably connected to said frame and comprising an interior surface and an exterior surface and a center axis; and a temperature sensor comprising a line of sight and operatively connected to said frame with said line of sight directed at a portion of said interior surface at an acute angle to said center axis.

21. An apparatus for controlling a heating device in a laundry ironer comprising:

a frame;

an ironer cylinder rotatably connected to said frame and comprising an interior surface and an ironing exterior surface extending substantially from a first end to a second end of said ironer cylinder;

a heating element extending into said cylinder;

a shield in said cylinder comprising a heating element side and a shielded side;

an infra-red temperature sensor operatively connected to said frame outside said ironer cylinder near said first end, wherein a line of sight of said infra-red temperature sensor is operatively directed at a portion of said interior surface adjacent said shielded side; and an operative electrical connection from said infra-red temperature sensor to said heating element.

* * * * *